United States Patent [19]

Murrer et al.

[11] Patent Number: 4,976,831

[45] Date of Patent: Dec. 11, 1990

[54] PROCESS FOR MAKING A POLYMER-MODIFIED ELECTRODE AND PROCESS USING SAME FOR CHLORALKALI ELECTROLYSIS

[76] Inventors: Barry A. Murrer, 17 Carnarvon Road, Reading, Berks RG1 5SB; John Overstall, 28 Pine Road, Romsey, Hants S051 8SG; Peter M. Willis, 21, Wantage Road, Wallingford, Oxfordshire OXIO OLR, all of Great Britain

[21] Appl. No.: 480,376

[22] Filed: Feb. 14, 1990

Related U.S. Application Data

[63] Continuation of Ser. No. 201,266, Jun. 2, 1988, abandoned, which is a continuation of Ser. No. 915,254, filed as PCT GB86/00039 on Jan. 21, 1986, published as WO86/04364 on Jul. 31, 1986, abandoned.

[30] Foreign Application Priority Data

Jan. 21, 1985 [GB] United Kingdom ..... 85/01479

[51] Int. Cl.[5] ..... C25B 1/02; C25B 11/06

[52] U.S. Cl. ..... 204/98; 204/128; 204/129; 204/290 R; 204/291; 204/292; 427/125; 427/126.5; 427/226; 427/385.5; 427/388.2; 427/388.5

[58] Field of Search ..... 204/98, 128, 290 R, 204/290 F, 292, 129, 291, 125, 126.5, 226, 388.2, 385.5, 388.5

[56] References Cited

U.S. PATENT DOCUMENTS

| | | | |
|---|---|---|---|
| 3,461,044 | 8/1969 | Lyons, Jr. et al. | 204/3 |
| 3,761,679 | 9/1973 | Dall | 204/290 R |
| 3,787,244 | 1/1974 | Schulmeister | 136/120 FC |
| 4,402,996 | 9/1983 | Gauger et al. | 427/86 |
| 4,427,523 | 1/1984 | Oda et al. | 204/290 R |
| 4,435,313 | 3/1984 | Katz et al. | 204/290 F |
| 4,459,324 | 7/1984 | Gauger et al. | 427/86 |
| 4,469,808 | 9/1984 | Korach | 204/290 R |

FOREIGN PATENT DOCUMENTS 2727852 1/1979 Fed. Rep. of Germany .

OTHER PUBLICATIONS

Chemical Abstracts, vol. 92, No. 6, Feb. 1980, Columbus, Ohio, (U.S.) col. 1, abstract No. 49479b and J.P.A. No. 79125186 (Tokuyama Soda Co., Ltd.) 09/28/79.

*Primary Examiner*—John F. Niebling
*Assistant Examiner*—Kathryn Gorgos
*Attorney, Agent, or Firm*—Cushman, Darby & Cushman

[57] ABSTRACT

A process for making a polymer-modified electrode comprising electrocatalytic metal, a metal substrate (1) and small polymer particles (2) by contacting the substrate with a (preferably aqueous) dispersion containing the particles and also a dissolved compound of electrocatalytic metal of greater electronegativity than the metal of the substrate, whereby contacting the substrate with the dispersion cause spontaneous deposition of electocatalyst, which in turn causes desposition of the particles onto the substrate, and then drying the substrate and deposit at a temperature below the softening point of the polymer. The deposited particles retain their shape and only a few are mutually contiguous, with the result that the poison resistance of the electrodes is increased and their overpotentials are reduced. Also, electrodes in which at least 70% of the particles are fully spaced from their neighbors and the amount of particles deposited is preferably from 0.0005 to 2 $cm^3$ $m^2$ of substrate surface. The electrodes are useful as chloralkali cathodes.

18 Claims, 1 Drawing Sheet

Figure 1:
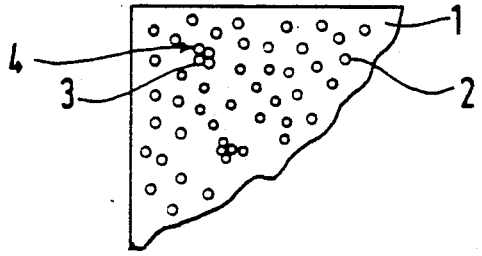

PROCESS FOR MAKING A POLYMER-MODIFIED ELECTRODE AND PROCESS USING SAME FOR CHLORALKALI ELECTROLYSIS

This is a continuation of application Ser. No. 07/201,266, filed June 2, 1988, now abandoned which is as PCT GB86/00039 on Jan. 21, 1986, published as WO86/04364 on Jul. 31, 1986, now abandoned which was abandoned upon the filing hereof.

This invention relates to a process for making a polymer-modified electrode and to an electrode made by the process.

European patent specification EP 0059854 the equivalent of U.S. Pat. No. 4,486,278 (the contents of which are herein incorporated by reference) discloses electrodes comprising an electrocatalyst, a metal substrate and a polymer deposited on the surface of the electrode, preferably in an amount of from 0.3 to 10 $cm^3/m^2$ and wherein the polymer has been heat-treated to a temperature of, for example, 300° C. or 350° C. in order to cause it to fuse, so that on cooling, it causes the electrocatalyst to adhere to the metal substrate. Such electrodes are said to facilitate the evolution of gases or to increase the poison-resistance of the electrocatalyst.

One of the objects of this invention is to provide a process for making a polymer-modified electrode which need not require the polymer to be fused and which produces a more effective electrocatalyst.

Accordingly, this invention provides a process for making a polymer-modified electrode which (at least when in use) comprises an electrocatalytic metal, a metal substrate and a polymer, wherein the process comprises the steps of (a) contacting the metal substrate with a dispersion comprising a polar liquid dispersant containing dispersed particles of organic polymer having a mean particle size of from 0.05 to 20 μm (preferably 0.1 to 5 μm) and dispersed compound of electrocatalytic metal, which metal is more electronegative than the metal of the substrate; whereby on contacting the substrate with the dispersion, both electrocatalyst and polymer spontaneously deposit onto the substrate, then (b) drying the metal substrate and its deposits to remove the dispersant, the drying being preferably performed at a temperature which is low enough to avoid fusion of the polymer 1 μm is $10^{-6}$ m.

It has been discovered that contacting the metal substrate with the compound of the more electronegative metal not only causes spontaneous deposition of electrocatalyst, but simultaneously, it causes deposition of polymer particles, and the deposited polymer particles adhere firmly to the metal substrate even when the particles have not been fused. It is not clear why they adhere firmly, but it is suspected that the electrocatalyst adheres directly both to the metal substrate and to the polymer, so that the electrocatalyst may act as a link which indirectly causes the polymer to adhere to the metal substrate. It has also been found that the polymer can be deposited in amounts as low as from 0.0005 to 0.2 $cm^3/m^2$; yet it still adheres firmly to the metal substrate.

By using the process of this invention, it is usually possible to deposit the polymer particles without seriously affecting their shape. This means that if the particles are spherical or spheroidal, the deposit of particles will be at least very porous because any contiguous particles will have little more than point contact with their neighboring particles. Moreover if the particles are deposited in small amounts from a lyophopic dispersion, the charge on the particles will help to space apart the deposited particles. Provided a monolayer of particles is deposited, probably at least 70% by number of the particles will be fully spaced from their neighbors, and usually only 10% by number are contiguous with neighboring particles. This spacing of the particles minimizes the extent to which the polymer adversely affects the electrical efficiency of the electrode or the evolution of gases from the electrode. For this reason, it is preferred to deposit polymer particles in amounts of from 0.0005 to 0.2 (preferably 0.001 to 0.1) $cm^3$; of polymer/m2 of nominal surface area of the metal substrate (that is to say, the surface area the substrate would have if it were perfectly smooth). Accordingly, this invention also provides a preferred polymer-modified electrode comprising an electrocatalytic metal, a metal substrate and a monolayer of spherical or spheroidal particles of an organic polymer adhered to the substrate, wherein at least 70% by number of the particles are fully spaced apart from neighboring particles and the amount of deposited particles is from 0.0005 to 0.2 $cm^3$; of polymer/m2 of nominal surface area of the metal substrate. Generally, it is difficult to achieve a monolayer if the amount of polymer deposited exceeds 0.3 $cm^3/m^2$. The number of particles deposited per unit area is governed by the preference for monolayers and the diameter of the particles, but usually the number of particles is from $(0.1 \text{ to } 5)\times 10^{13}/m^2$ of the nominal surface area of the metal substrate.

If required, the performance of the cathode can be improved by subjecting the deposited particles to heat treatment at temperatures up to 400° C., and preferably 300° to 360° C.

The polymer may be any organic homopolymer or copolymer or mixture of polymers obtainable as preferably spherical or spheroidal particles capable of forming a preferably lyophopic dispersion in a polar liquid dispersant. It is also preferred that the polymer be free from easily ionizable moieties. Polytetrafluoroethylene (PTFE) is the preferred polymer because it has a high softening point and is readily available as an aqueous dispersion of spheroidal particles. Preferably the metal substrate is contacted with an aqueous dispersion containing from 0.5 to 40 g/liter of PTFE particles.

The electrocatalytic metal must be more electronegative than the metal of the metal substrate, that is to say the electrocatalytic metal must be capable of being liberated from one or more of its compounds by metal from the substrate. This aside, the choice of the electrocatalytic metal and the metal substrate is determined by the requirements of the electrochemical process in which the electrode is to be used. For example electrodes made by the process of the invention are especially suitable for use as cathodes in the choralkali process where they can achieve low overpotentials for the liberation of hydrogen. Low overpotentials can be sustained for long periods of time leading to substantial reductions in the electrical power consumed in the chloralkali Process. Accordingly this invention also provides a method for reducing the consumption of electrical power in a chloralkali process wherein a cathode made according to this invention is used as the cathode in the chloralkali process.

For use in the chloralkali process, it is preferred that the metal substrate be a nickel substrate and that the electrocatalytic metal be chosen from platinum, ruthenium, rhodium or palladium or their mixtures or alloys. Mixtures or alloys of platinum and ruthenium are especially preferred. The electrocatalyst is preferably dispersed in the polar dispersant in the form of a soluble compound, such as chloroplatinic acid or ruthenium trichloride. The solution is conveniently mixed with the dispersion of polymer and the mixture is conveniently contacted with the metal substrate by dipping the substrate into the mixture. Other contacting techniques include spraying and painting the mixture onto the substrate.

It is preferred to dry the contacted metal substrate by allowing it to stand in air at room temperature. It is preferred that the metal substrate, after contacting with the mixture, should not be exposed to a temperature of more than 100° C. below the softening point of the polymer.

The invention is further illustrated by the following preferred embodiment which is described with reference to FIG. 1 of the drawings.

FIG. 1 is a diagrammatic plan view of a portion of an electrode made according to this invention.

FIG. 1 shows a nickel substrate 1 to which are adhered spheroidal particles 2 of PTFE. The number average maximum diameter of the particles is 0.2 μm and it will be seen that particles 2 are all fully spaced apart from neighboring particles. Also adhering to substrate 1 are a few PTFE particles 3 which are contiguous and form an array 4 of four touching particles. These arrays seldom contain more than 7 particles. The precise positioning of the electrocatalyst cannot be located with certainty and so is not shown in FIG. 1.

The invention is further illustrated by the following Examples of which Examples A to C are comparative.

EXAMPLES 1 AND A

For the purposes of Example 1, an electrode was made as follows:

A solid nickel substrate was grit blasted to roughen its surface, then washed in acetone to remove any grease, then treated with 2N hydrochloric acid to activate the surface. The roughened substrate was dipped for 20 minutes into an aqueous dispersion consisting of demineralized water, PTFE particles and dissolved chloroplatinic acid and ruthenium trichloride. The dispersion contained 20 g/liter of spheroidal PTFE particles having a number average maximum diameter of 0.2 μm. The dispersion also contained 2 g/liter of platinum moiety and 2 g/liter of ruthenium moiety. Dipping the nickel substrate into the dispersion brought it into contact with dispersed PTFE particles, whereupon a steady deposition of the moieties and particle onto the substrate occurred. After 20 minutes, the substrate was removed from the dispersion and washed with warm (60° C.) demineralized water to remove any excess chloroplatinic acid or ruthenium trichloride on the substrate. Finally the washed electrode was allowed to dry in air at room temperature.

Examination of the electrode showed it to comprise a monolayer containing from (4 to 10)$\times 10^{12}$ spheroidal PTFE particles/m$^2$ of the nominal surface area of the substrate which amounted to 0.04 cm$^3$ of PTFE/m$^2$ of nominal substrate surface area. The particles were firmly adhered to the substrate. At least 90% of the particles were fully spaced from their neighbors.

The electrode was tested as a cathode in a catholyte consisting of demineralized water containing 35 wt. % of caustic soda and 500 ppm by weight of ferrous iron which had been introduced into the catholyte as a saturated solution of ferrous sulphate in demineralized water. The ferrous iron was added at a rate of 10 ppm initially, a further 50 ppm after two days, a further 100 ppm after four days and the final 340 ppm after five days. The cell was maintained at 90° C. and a current density of 3 kA/m$^2$ was passed. Hydrogen was liberated at the cathode and the variation in overpotential with time is shown in Table 1.

Table 1 shows that the hydrogen overpotential increases with the addition of poisonous ferrous ion and then settles down to a level of about 55 mV. The best overpotentials obtained according to the disclosure of EP 0059854 were 80 mV, using a poison concentration of only 100 ppm iron and the less exacting current density of 2 kA/m$^2$.

For the purposes of Comparative Example A, the procedure of Example 1 was repeated, except that the particles of PTFE were omitted from the dispersion. The hydrogen overpotentials obtained are again shown in Table 1.

TABLE 1

| | Hydrogen Overpotentials in mV obtained after various numbers of days of operation as shown below: | | | | | | |
|---|---|---|---|---|---|---|---|
| Example | 0 | 2 | 4 | 5 | 8 | 12 | 15 |
| 1 | 19 | 36 | 53 | 61 | 70 | 57 | 55 |
| A | 29 | 56 | 109 | 115 | 129 | 123 | 131 |

It will be seen from Table 1 that omission of the PTFE particles more than doubles the hydrogen overpotential after the full amount of poisonous ferrous ions have been added to the catholyte.

EXAMPLES 2 AND B

The procedures of Examples 1 and A were repeated except that the concentration of poisonous ferrous ions in the catholyte was 20 ppm by weight and the poison was all added at the start of the tests.

In the case of Example 2 (the PTFE-modified cathode), the hydrogen overpotential after 1 day was 63 mV which then reached 67 mV after 20 days and was still 67 mV after 40 days. In the case of Comparative Example B (no PTFE), the overpotential after 1 day was 150 mV which then reached 162 mV after 20 days and was still 162 mV after 40 days. This again suggests that the omission of PTFE more than doubles the hydrogen overpotential. It also indicates that the poison causes an initial increase in overpotential and thereafter the overpotential remains approximately constant.

EXAMPLE C

A cathode was made according to the procedure of Comparative Example B. After washing and drying, it was dipped for 20 minutes into a dispersion of spheroidal particles of PTFE in demineralized water. The dispersion contained 300 g/liter of PTFE and the size of the PTFE particles was the same as those used in the preceding Examples. On removal from the dispersion of PTFE, the cathode was dried in air at room temperature and then heated in nitrogen for 1 hour at a temperature of 350° C. The cathode was then allowed to cool back to room temperature, whereupon it was found to comprise 0.12 cm$^3$ of PTFE/m$^2$ of nominal substrate surface area. The cathode was tested in the chloralkali catholyte in accordance with the procedure of Example 1, except that the catholyte was maintained at room temperature.

The cathode exhibited a hydrogen overpotential of 493 mV, which is equivalent to about 300 mV at 90° C.

We claim:

1. A polymer modified electrode for use as a cathode in a chloralkali process, comprising:

(a) a metal substrate;

(b) an electrocatalytic metal that is more electronegative than the metal of the substrate and that is in the form of a deposit on the substrate that has formed spontaneously as a result of an exchange deposition between the metal of the substrate and a compound of the electrocatalytic metal; and (c) a single layer of spherical or spheroidal solid particles of an organic polymer adhered to the substrate simultaneously with deposition of the electrocatalytic metal, the particles having an average size of from 0.05 to 20 μm and being present on the substrate in an amount of 0.0005 to 0.2 $cm^3$ of polymer per $m^2$ of nominal surface area of the substrate wherein at least 70% by number of the particles are fully spaced apart from neighboring particles, whereby in use in the chloralkali process, the electrode exhibits a low hydrogen overvoltage and a resistance to poisoning by ferrous ions.

2. An electrode according to claim 1, wherein the metal of the substrate is nickel.

3. An electrode according to claim 2, wherein the electrocatalytic metal is a metal or a mixture or an alloy of metals selected from platinum, ruthenium, rhodium and palladium.

4. An electrode according to claim 3, wherein the polymer is polytetrafluoroethylene.

5. A chloralkali process in which evolution of hydrogen occurs at the cathode and comprising the step of passing a current though an electrolytic cell containing an aqueous solution of an alkali metal chloride, in which the cathode is a polymer modified electrode as claimed in claim 4.

6. A chloralkali process in which evolution of hydrogen occurs at the cathode and comprising the step of passing a current through an electrolytic cell containing an aqueous solution of an alkali metal chloride, in which the cathode is a polymer modified electrode as claimed in claim 2.

7. A chloralkali process in which evolution of hydrogen occurs at the cathode and comprising the step of passing a current through an electrolytic cell containing an aqueous solution of an alkali metal chloride, in which the cathode is a polymer modified electrode as claimed in claim 3.

8. An electrode according to claim 1, wherein at least 90% of the particles are fully spaced apart from neighboring particles.

9. An electrode according to claim 8, wherein the number of particles on the substrate is from $0.1\times10^{15}$ to $5\times10^{13}$ of the nominal surface area of the substrate.

10. A chloralkali process in which evolution of hydrogen occurs at the cathode and comprising the step of passing a current through an electrolytic cell containing an aqueous solution of an alkali metal chloride, in which the cathode is a polymer modified electrode as claimed in claim 9.

11. A chloralkali process in which evolution of hydrogen occurs at the cathode and comprising the step of passing a current through an electrolytic cell containing an aqueous solution of an alkali metal chloride, in which the cathode is a polymer modified electrode as claimed in claim 8.

12. A process for making the polymer modified electrode claimed in claim 1, which comprises the steps of:

(a) contacting the substrate with a dispersion comprising a polar liquid dispersant containing dispersed particles of the organic polymer of number average particle size of from 0.05 to 20 μm and a dispersed compound of the electrocatalytic metal so that on contact with the substrate both the electrocatalytic metal and the polymer are spontaneously deposited onto the substrate, the electrocatalytic metal being deposited onto the substrate as a result of an exchange deposition between the metal of the substrate and the compound of the electrocatalytic metal; and then (b) removing the dispersant from the metal substrate by drying at a temperature that is low enough to avoid fusion of the polymer.

13. A process according to claim 12, wherein the dispersion comprises particles of the organic polymer in lyophobic dispersion in the liquid dispersant.

14. A process according to claim 13, wherein the organic polymer is polytetrafluoroethylene.

15. A process as claimed in claim 14, wherein the dispersant is water containing a water-soluble compound of platinum and a water-soluble compound of ruthenium.

16. A chloralkali process in which evolution of hydrogen occurs at the cathode and comprising the step of passing a current through an electrolytic cell containing an aqueous solution of an alkali metal chloride, in which the cathode is a polymer modified electrode as claimed in claim 1.

17. A chloralkali process in which evolution of hydrogen occurs at the cathode and comprising the step of passing a current through an electrolytic cell containing an aqueous solution of an alkali metal chloride, in which the cathode is a polymer modified electrode as claimed in claim 1, said electrode being one which is prepared by the steps of:

(a) contacting the substrate with a dispersion comprising a polar liquid dispersant containing dispersed particles of the organic polymer of number average particle size of from 0.05 to 20 μm and a dispersed compound of the electrocatalytic metal so that on contact with the substrate both the electrolytic metal and the polymer are spontaneously deposited onto the substrate, the electrocatalytic metal being deposited onto the substrate as a result of an exchange deposition between the metal of the substrate and the compound of the electrocatalytic metal; and then (b) removing the dispersant from the metal substrate by drying at a temperature that is low enough to avoid fusion of the polymer.

18. A polymer modified electrode for use as a cathode in a chloralkali process, comprising:

(a) a nickel substrate;

(b) an electrocatalytic metal deposited on the substrate that is more electronegative than nickel and that is the result of an exchange deposition with a compound of the electrocatalytic metal; and (c) a single layer of spherical or spheroidal solid particles of an alkali-resistant organafluorine polymer adhered to the substrate simultaneously with deposition of the electrocatalytic metal, the particles having an average size of from 0.05 to 20 μm and being present on the substrate in an amount of 0.0005 to 0.2 $cm^3$ of polymer per $m^2$ of nominal surface area of the substrate wherein at least 70% by number of the particles are fully spaced apart from neighboring particles, whereby in use in the chloralkali process, the electrode exhibits a low hydrogen overvoltage and a resistance to poisoning by ferrous ions.

* * * * *